US009347452B2

(12) United States Patent
Tamminen et al.

(10) Patent No.: US 9,347,452 B2
(45) Date of Patent: May 24, 2016

(54) STALL DETECTION IN FANS UTILIZING FREQUENCY CONVERTER

(75) Inventors: Jussi Tamminen, Helsinki (FI); Tero Ahonen, Helsinki (FI); Jero Ahola, Helsinki (FI)

(73) Assignee: ABB TECHNOLOGY OY, Helsinki (FI)

( * ) Notice: Subject to any disclaimer, the term of this patent is extended or adjusted under 35 U.S.C. 154(b) by 1092 days.

(21) Appl. No.: 13/434,243

(22) Filed: Mar. 29, 2012

(65) Prior Publication Data

US 2012/0253700 A1 Oct. 4, 2012

(30) Foreign Application Priority Data

Mar. 31, 2011 (EP) ..... 11160573

(51) Int. Cl.
*F04D 27/00* (2006.01)
*F04D 19/02* (2006.01)

(52) U.S. Cl.
CPC ..... *F04D 27/001* (2013.01); *F04D 19/02* (2013.01)

(58) Field of Classification Search
CPC ..... F04D 27/001; F04D 19/002
USPC ..... 702/41
See application file for complete search history.

(56) References Cited

U.S. PATENT DOCUMENTS 5,594,665 A * 1/1997 Walter et al. ..... 700/301
5,767,780 A 6/1998 Smith et al.
6,516,279 B1 * 2/2003 Jansen et al. ..... 702/66
2003/0021089 A1 * 1/2003 Belady et al. ..... 361/695
2005/0031443 A1 * 2/2005 Ohlsson et al. ..... 415/30
2007/0212210 A1 9/2007 Kernan et al.
2007/0212229 A1 9/2007 Stavale et al.
2007/0212230 A1 9/2007 Stavale et al.

(Continued)

FOREIGN PATENT DOCUMENTS

CN 101033744 A 9/2007
CN 101076671 A 11/2007
CN 101750258 A 6/2010

OTHER PUBLICATIONS

Office Action issued on Mar. 31, 2014, by the Chinese Patent Office in corresponding Chinese Patent Application No. 201210091348.7 and an English translation of the Office Action. (18 pages).

(Continued)

*Primary Examiner* — Gregory J Toatley
*Assistant Examiner* — Terence Stifter, Jr.
(74) *Attorney, Agent, or Firm* — Buchanan Ingersoll & Rooney PC

(57) ABSTRACT

Exemplary methods and systems of determining stall of a fan are disclosed, when the fan is controlled with a frequency converter. The method includes estimating a rotational speed (n) and the torque (T) of the fan. Transferring characteristic curves of the fan to the estimated rotational speed (n) of the fan, determining the stall region of the fan. Determining an operation point of the fan from the estimated rotational speed (n) and estimated torque (T) using the characteristic curves. Calculating RMS values of the low frequency components of the torque and rotational speed estimates ($T_{RMS}$, $n_{RMS}$) to obtain a low frequency parameter (S), and determining an occurrence of stall based on at least one of the operation point and the low frequency parameter (S).

14 Claims, 3 Drawing Sheets

(56) References Cited

U.S. PATENT DOCUMENTS

| | | | | |
|---|---|---|---|---|
| 2009/0204245 | A1* | 8/2009 | Sustaeta et al. | 700/99 |
| 2009/0252617 | A1 | 10/2009 | Mertens et al. | |
| 2010/0143157 | A1 | 6/2010 | Ahonen et al. | |
| 2010/0198480 | A1 | 8/2010 | Mertens et al. | |
| 2010/0295500 | A1* | 11/2010 | Chakrabarti et al. | 318/812 |

OTHER PUBLICATIONS

European Search Report dated Sep. 8, 2011 for EP 11160573.

* cited by examiner

STALL DETECTION IN FANS UTILIZING FREQUENCY CONVERTER

RELATED APPLICATION

This application claims priority under 35 U.S.C. §119 to European Patent Application No. 11160573.9 filed in Europe on Mar. 31, 2011, the entire content of which is hereby incorporated by reference in its entirety.

FIELD

The present disclosure relates to fans, such as fans controlled with a frequency converter.

BACKGROUND INFORMATION

Fans are widely used appliances in industrial and service sector. They can be important components in production processes, and a failure of a fan system can cause significant production losses and hazards to worker safety. In addition to their importance in production processes, fan systems consume vast amounts of electrical energy. One sixth of the electricity consumed in electrical motors is consumed by fan systems in the industrial sector, and over one fourth in the service sector.

The use of frequency converters in the control of fan systems has become common, and will increase in the future, because of the efficiency benefits of rotational speed control. Frequency converters can also produce estimates of the state of the motor, including shaft mechanical torque and rotational speed, based on the motor model and internal current and voltage measurements. With the help of fan parameters provided by the fan manufacturers, these estimates can be used to determine the operating point of a fan (i.e., the produced flow rate and pressure).

Stalling phenomenon is one of the most common harmful events occurring in a fan, and it can reduce the service life and reliability of a fan. There is equipment available for reducing the risk of a fan stall, for example, by altering the upstream flow, but no known method for detecting a stall occurrence in a fan without the use of external measurements.

SUMMARY

An exemplary method of determining stall of a fan is disclosed, when the fan is controlled with a frequency converter having means for providing a rotational speed estimate of the fan and torque estimate of the fan and when the characteristic curves of the fan are known, the method comprising: estimating rotational speed (n) of the fan; estimating torque (T) of the fan; transferring the characteristic curves of the fan to the estimated rotational speed (n) of the fan; determining a stall region of the fan from the characteristic curves; determining an operating point of the fan from the estimated rotational speed (n) and the estimated torque (T) using the characteristic curves; calculating RMS values of the low frequency components of the torque and rotational speed estimates ($T_{RMS}$, $n_{RMS}$); combining the calculated RMS values of the low frequency components of the torque and rotational speed estimates ($T_{RMS}$, $n_{RMS}$) for obtaining a low frequency parameter (S); and determining an occurrence of stall when at least one of the operating point of the fan is in the stalling region and when the low frequency parameter (S) is above a set limit.

An exemplary system of determining stall of a fan is disclosed, when the fan is controlled with a frequency converter having means for providing a rotational speed estimate of the fan and a torque estimate of the fan and when characteristic curves of the fan are known, the system comprising: means for estimating rotational speed (n) of the fan; means for estimating torque (T) of the fan; means for transferring the characteristic curves of the fan to the estimated rotational speed (n) of the fan; means for determining a stall region of the fan in the characteristic curves; means for determining an operation point of the fan from the estimated rotational speed (n) and the estimated torque (T) using the characteristic curves; means for calculating RMS values of low frequency components of the torque and rotational speed estimates ($T_{RMS}$, $n_{RMS}$); means for combining the calculated RMS values of the low frequency components of the torque and rotational speed estimates ($T_{RMS}$, $n_{RMS}$) for obtaining a low frequency parameter (S); and means for determining an occurrence of stall when at least one of the operation point of the fan is in the stalling region and the low frequency parameter (S) is above a set limit.

BRIEF DESCRIPTION OF THE DRAWINGS

In the following the disclosure will be described in greater detail by means of exemplary embodiments with reference to the accompanying drawings, in which.

DETAILED DESCRIPTION

Figure 1:
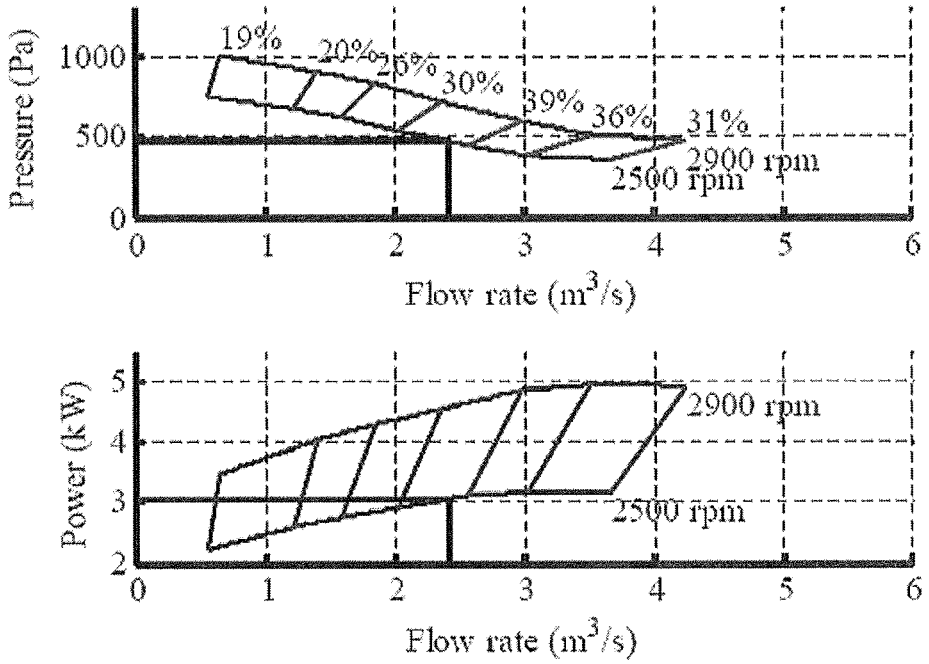
FIG. 1 shows an example of QP calculation for determining an operating point in accordance with an exemplary embodiment.

Exemplary embodiments of the present disclosure provide a method and arrangement for implementing the method so as to solve the above problem relating to the detection of stalling.

The exemplary embodiments described herein use disclosure estimates provided by a frequency converter driving the fan and characteristic curves of the fan. A frequency converter produces estimates for the shaft torque and rotational speed of the motor connected to the fan. These estimates are later referred to as the fan torque estimate and the fan rotational speed estimate. This information can be used for determining the operation point location of the fan. When the operating point of the fan is in the stalling region or when low-frequency variations in power are detected, the stalling of a fan is probable. According to an exemplary embodiment, both above indications are combined for more accurate determination of the stall.

Exemplary embodiments of the present disclosure are advantageous because the fan stalling can be estimated accurately without any additional sensors or measurements. If the stall condition is detected, the fan can be controlled to another operating point so that stalling of the fan does not wear or break the fan or any other structures relating to the fan.

The operating point location of a fan can be determined by the flow rate and pressure produced by the fan ($Q_v$ and p, respectively). The operating point can be estimated using the rotational speed estimate $n_{est}$ and torque estimate $T_{est}$ and the fan curves published by the manufacturer. This method is known and will be referred to as the QP calculation. The operating point can be used to asses the energy efficiency of a fan system and to decide, if a fan is susceptible to stall.

The stall phenomenon is said to cause the following, among other things pulsating airflow noise and system ducts that seem to breathe in response to the pressure variations. These phenomena are assumed to produce low frequency time domain variation (e.g. 0-2 Hz) in the power consumption of the fan. It has been noticed that these variations in power can be found in the estimates of torque and rotational speed of a frequency converter. The magnitudes and relations of the variations depend on the characteristics of the fan system and internal control structure of the frequency converter.

QP calculation and monitoring of the estimate fluctuation can be utilized for stall detecting individually or together with each other. By combining these two methods the reliability of the diagnosis can be increased compared to the use of the individual methods.

The method of the disclosure is divided into three consecutive functions in the following: the estimation of the fan operating point location, the measurement of the reference value for the low frequency fluctuation of the torque and rotational speed estimates, and determination of the occurrence of stall based on the operation point and/or a measured reference value.

Estimation of the Fan Operating Point Location

The fan operating point location can be continuously estimated utilizing the fan characteristic curves and the rotational speed and torque estimates of the frequency converter ($n_{est}$ and $T_{est}$, respectively). This method is called the QP calculation. The mechanical power of the fan can be calculated from the torque and rotational speed estimates, when they are known in the rpm and Nm units:

$$P_{mech} = \omega_{est} T_{est} = \frac{2\pi}{60} n_{est} T_{est} \tag{1}$$

The fan's flow rate to power ($Q_v$, P) and flow rate to pressure ($Q_v$, p) characteristic curves are modified to the current rotational speed with affinity equations.

$$Q_v = \left(\frac{n}{n_0}\right) Q_{v0}, \tag{2}$$

$$p = \left(\frac{n}{n_0}\right)^2 p_0, \tag{3}$$

$$P_{mech} = \left(\frac{n}{n_0}\right)^3 p_{mech0}, \tag{4}$$

where $Q_v$ is the flow rate, p is the fan pressure, $P_{mech}$ is the fan's mechanical power consumption, n is the rotational speed, and the subscript 0 denotes the initial values given by the manufacturer. A graphical example of the QP calculation, with these corrected curves, is presented in FIG. 1.

FIG. 1 shows an example of QP calculation for determining an operating point in accordance with an exemplary embodiment. In FIG. 1, the flow rate is estimated from the power, and pressure is then estimated from the estimated flow rate. The curves originally given at rotational speed of 2900 rpm are transferred to speed of 2500 rpm using the affinity equations (2)-(4). Flow rate to pressure (Qp) curve also shows the efficiency of the fan in a given operating point.

Figure 2:
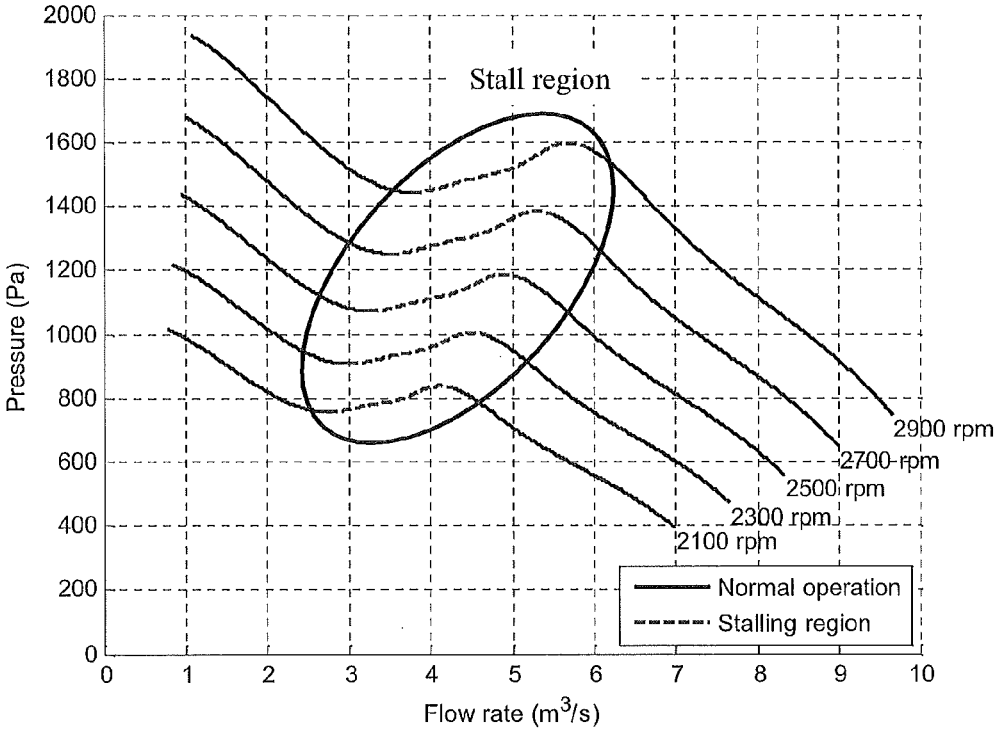
FIG. 2 shows an example of stalling region in an axial fan in accordance with an exemplary embodiment.

FIG. 2 shows an example of stalling region in an axial fan in accordance with an exemplary embodiment. The operating point of FIG. 1 can be used to determine the probability of stall in fans. Fans usually have a stall area at some flow rate region, as shown in FIG. 2, which is given in the published characteristic curves. In this region the pressure produced by the fan drops and the fan stalls.

The stalling region can be given for a specific rotational speed, and the stall region can be shifted to the right rotational speed with the affinity equations (2)-(4) as shown in FIG. 2.

When considering the region where the fan is susceptible to stall, a wider area should be regarded as the avoidable operation region than just the region where the output pressure drops. Under the conditions of FIG. 2, this avoidable region is considered to be from 2.5 to 6.5 $m^3/s$ at the 2900 rpm characteristic curve. The reason for this precaution is the nature of stall. It is dependable on the characteristics of the medium that is transported with the fan (temperature, humidity), the accuracy of the blade angles. Stalling also embodies some hysteresis, which is why in the same operating point the operation can be either stalling or normal, depending on the direction the point is approached.

Measurement of Reference Value for Low Frequency Fluctuation of Torque and Rotational Speed Estimates The RMS values for the low frequency fluctuation of the torque and rotation speed estimates are acquired from a data set that represents the current conditions. This data set can be at least five seconds long with a sufficient sampling frequency and when the fan is operated at a constant torque or rotational speed reference. The RMS values of the low frequency fluctuations of the torque and rotational speed estimates are determined from the estimates without the DC level, which will later be referred to as an unbiased estimate. The unbiased estimate $e_{unbias}$ for variable e can be calculated as $$e_{unbias} = e(k) - \bar{e} \tag{5}$$

where e(k) is the estimate and $\bar{e}$ is the mean value of the estimate data set. The frequency band for low frequencies can be in a range determined to be from 0 to 2 Hz. This frequency band can be obtained by decimation, filtering or some other kinds of signal conditioning. The filtered estimate will be referred as $e_{filtered}$. The RMS value of the estimate is calculated as:

$$e_{RMS} = \sqrt{\frac{1}{m} \sum_{k=0}^{m} e_{filtered}^2(k)} \tag{6}$$

where m is the number of samples in the filtered unbiased discrete time set and k is the index of the sample in the set. This RMS value obtained by equation (6) is used for the evaluation of the low frequency estimate fluctuation, which is an indication of stall. Thus the RMS values for torque and rotational speed estimates $T_{RMS}$, $n_{RMS}$ can be calculated using equation (6).

According to an embodiment of the disclosure, if the operating point of the fan is outside a defined stall region, then the RMS value for the estimate is saved as a reference for the acceptable variation. Both the RMS values for the rotational speed estimate and the torque estimate are saved. When there is more than one measurement, the reference value can be calculated as an arithmetic mean of the measurements.

$$T_{reference} = \frac{1}{m}\sum_{m} T_{RMS} \tag{7}$$

$$n_{reference} = \frac{1}{m}\sum_{m} n_{RMS} \tag{8}$$

where m is the number of measurements made.

Figure 3:
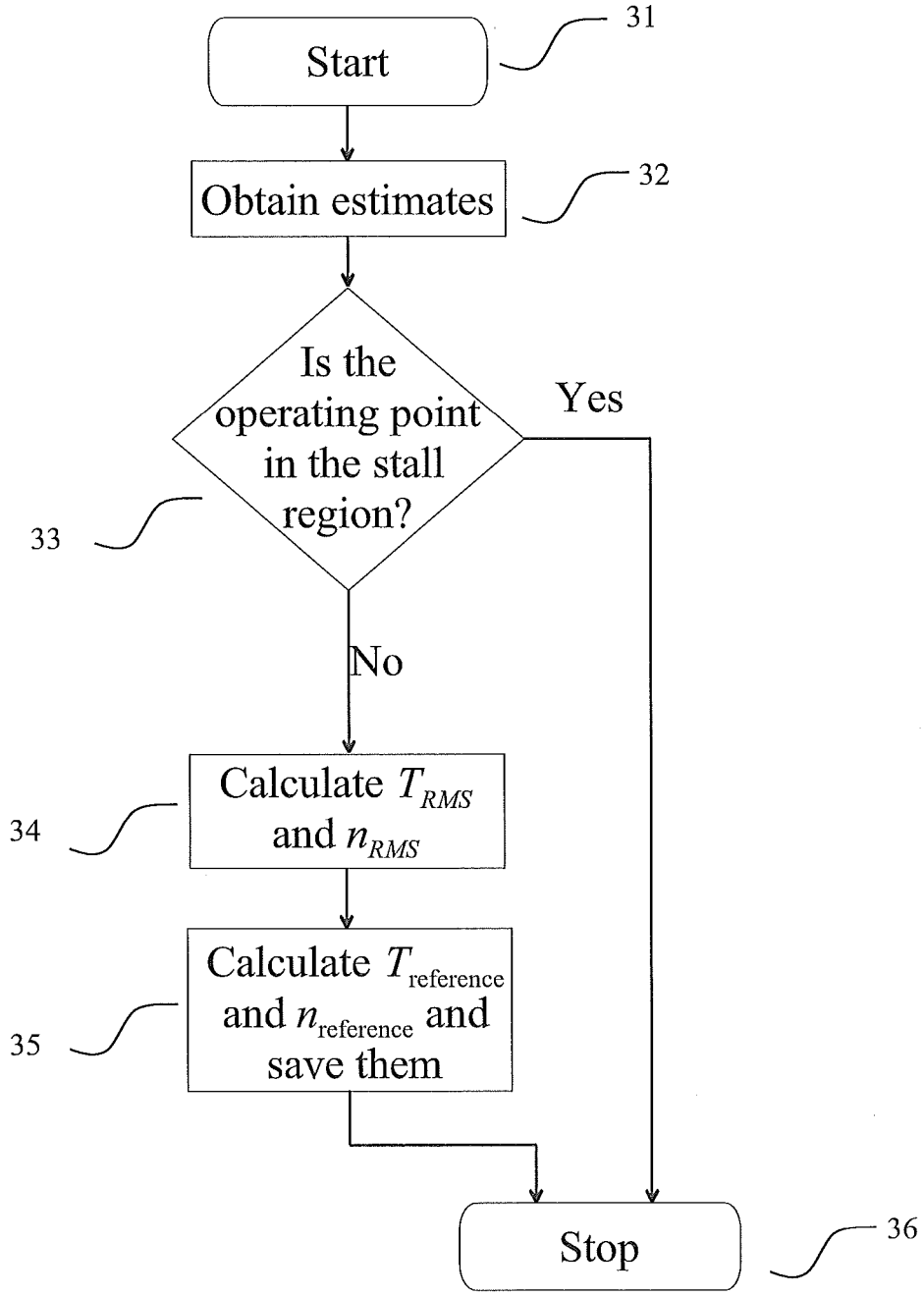
FIG. 3 shows a flow chart for the function of calculating reference values for low frequency RMS magnitudes in accordance with an exemplary embodiment.

FIG. 3 shows a flow chart for the function of calculating reference values for low frequency RMS magnitudes in accordance with an exemplary embodiment. As shown in FIG. 3, the procedure is started at 31, and the estimates for the rotational speed and torque are obtained at 32. As explained above, the estimates are obtained directly from the frequency converter that is controlling the fan system.

Once the estimates are obtained, the operating point is determined and it is checked if the operating point of the fan is in the defined stall region 33. If the operating point is in the stall region, the procedure is stopped 36. If, on the other hand the operating point is not in the stall region, values for $T_{RMS}$ and $n_{RMS}$ are calculated 34 according to the equations given above.

Once the operating point of the fan was not in the stall region, the calculated RMS values are used for calculation 35 of reference values of torque and rotational speed as explained above. After the calculation of the reference values the procedure is stopped 36.

Determining the Occurrence of Stall

The function for determining the occurrence of stall utilizes the two functions described before: the estimation of the fan operating point location and the measurement of the reference value for the low frequency fluctuation of the torque and rotational speed estimates.

Firstly, the operating point of the fan is determined, and the operating point is investigated whether or not it is within a stall region of the fan as already explained above. The RMS value of the low frequency estimate fluctuation is calculated, when the rotational speed or torque reference for the frequency controller has remained constant for the time of the measured data set. Secondly, the acquired RMS values are made dimensionless by dividing the RMS values with the reference values for obtaining a low frequency parameter S.

The control system of the frequency converter and its parameters determine, whether the load oscillation caused by stalling is visible as a fluctuation either in the torque or rotational speed estimate, or in both. Thus, in order to make the method less dependent on the control method applied in the converter, a geometric sum of the dimensionless values can be formed.

$$S = \sqrt{\left(\frac{n_{RMS}}{n_{reference}}\right)^2 + \left(\frac{T_{RMS}}{T_{reference}}\right)^2} \tag{9}$$

where S is the variable used for stall detection and $n_{RMS}$ and $T_{RMS}$ are the RMS values of low frequency fluctuation for rotational speed and torque, respectively.

According to an embodiment, the logic for the stall detection takes account of both of the previous mentioned functions to improve the reliability of the method. If the fan is operating in a stall region and S is above its limit value, then the fan is considered as stalling. According to an embodiment, when the fan is operating in a stall region, and the parameter S is below its limit value, the fan is not considered to stall. Otherwise, if the fan is operated outside the stall region, the fan is not considered to stall.

It is up to the user of the fan system to decide if the stall detection is carried out from one indicator (stall region or parameter S) or from both indicators.

Figure 4:
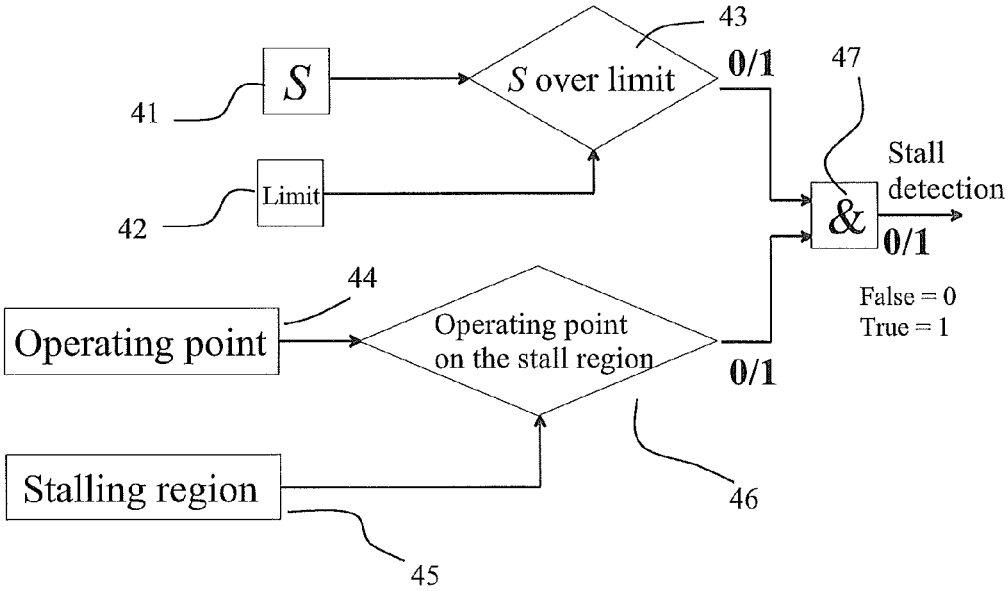
FIG. 4 shows a flow chart of stall detection in fans in accordance with an exemplary embodiment.

FIG. 4 shows a flow chart of stall detection in fans in accordance with an exemplary embodiment. The logic for this decision making can be seen in FIG. 4. In FIG. 4, the value 1 represents the logical value for true and the value zero for false. The limit value for S can be set as desired, for example as 2, which has provided desired results in the conducted laboratory tests.

As shown in FIG. 4, the calculated parameter S and limit value for S are given as inputs 41, 42. Once these values are input, it is checked 43 if parameter S is higher than the given limit. As a result of the comparison either 0 or 1 is outputted to logical AND block 47. If the result of the comparison in block 43 is true, i.e. parameter S indicates stalling, 1 is outputted from the block 43.

Other inputs include the estimated operating point 44 and the defined stall region 45. Logic block 46 checks whether or not the operating point is in the stall region. If the operating point falls within the stall region, block 46 outputs 1 as an indication of the possibility of the occurrence of stall. If the operating point is outside the stall region, the output from the block 46 is 0. The output from the block 46 is fed to logical AND block 47.

Once both the used indicators indicate stall, the output from the block 47 is true, and it is determined that the fan is stalling. As mentioned above, the decision for the stall can also be based on only one of the indicators. In FIG. 4 this means that the logical AND block 47 is replaced by a logical OR operator.

Changes in rotational speed have no significant effect on the RMS values of the low frequency fluctuations of torque or rotational speed. To eliminate the possibility that the changed rotational speed causes erroneous calculation of S, the estimation can be made in the same rotational speed region for which the $T_{reference}$ and $n_{reference}$ have been determined.

This region can be for example±150 rpm wide for a fan with a 2900 rpm nominal rotational speed (i.e., about 10% speed range compared with the nominal speed). If the fan operates on a wide rotational speed region, it might be reasonable to have different $T_{reference}$ and $n_{reference}$ values for different sections of the used rotational speed region.

Evaluation of the Method

The method of the disclosure was tested with a frequency-converter-fed fan system comprising (e.g., consisting of) the components given in Table 1.

TABLE 1

| Axial Fan - FläktWoods Axipal BZI VA 630 4P 7 STD | | | | |
|---|---|---|---|---|
| Nominal Rotational Speed | Nominal Flow Rate | Nominal Total Pressure | Nominal Power | Nominal Efficiency |
| 2900 rpm | 2.4 $m^3/s$ | 900 Pa | 11 kW | 49.96% |
| **Induction Motor - ABB 3GAA131003-ADE** | | | | |
| Nominal Rotational Speed | Nominal Frequency | Nominal Power | Nominal Current | Nominal cos ϕ |
| 2880 rpm | 50 Hz | 11 kW | 21 A | 0.91 |
| **Frequency Converter - ABB ACS850-04-030A-5** | | | | |
| Nominal Output Current | Input Voltage Range | Output Frequency | Control Method | Nominal Power |
| 30 A | 380-480 V | 0-500 Hz | DTC | 15 kW |

Figure 5:
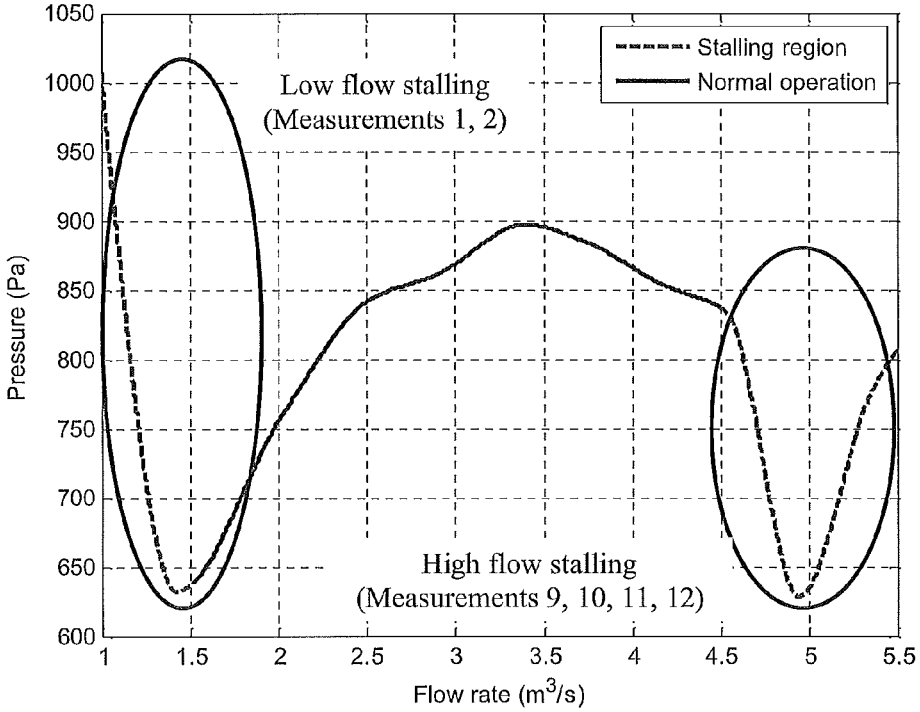
FIG. 5 shows a measured fan curve of the fan under test in accordance with an exemplary embodiment.

FIG. 5 shows a measured fan curve of the fan under test in accordance with an exemplary embodiment. The fan system was tested in such conditions that it had two stall regions, one in the low flow area and another in the high flow area. These can be seen in FIG. 5 as circled regions in the characteristic curve. On the low flow stall region, stalling causes excessive heating of the air being moved and increased vibrations of the fan and piping. On the high flow stall region the stall can be defined by the loss of output pressure. Later, in the results section, these operating points are identified as no. 1 for the low flow region and measurement nos. 10-12 on the high flow region, respectively. The measurements no. 2 and no. 9 are on the border, where stalling either might occur or might not occur.

The RMS values were calculated from data sets having a duration of 6.4 seconds and a sampling frequency of 500 Hz. Firstly, the DC level (i.e. mean value of each data set) was removed from the estimates. Then the estimates were decimated to the sampling frequency of 60 Hz, and then they were filtered with a discrete-time IIR filter. Finally, the frequency content of the unbiased and filtered estimates was determined by applying a Welch method for the power spectral density estimation. This rise in the estimate low frequency fluctuation in the stalling regions (measurements 1, 2, 9, 10, 11, 12) was obvious in the measurements. The measurements were conducted with a constant 2700 rpm rotational speed reference and the flow was controlled with a valve.

The low frequency fluctuation RMS values for $n_{RMS}$ and $T_{RMS}$ were calculated from the unbiased and filtered estimates with equation (6). The estimated flow rates for the measurements, the location in the stall region, the variable S and the decision of stall are given in Table 2. The limit value for S was fixed as 2. It can be seen that the algorithm estimates the occurrence of stall correctly, as can be expected.

TABLE 2

| | Measurement Number | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Estimated flow rate ($m^3/s$) | 0.9 | 1.3 | 2.0 | 2.5 | 2.9 | 3.4 | 3.8 | 4.2 | 4.6 | 5.5 | 5.5 | 5.5 |
| On the stall region (yes 1/no 0) | 1 | 1 | 0 | 0 | 0 | 0 | 0 | 0 | 1 | 1 | 1 | 1 |
| S | 3.6 | 2.5 | 1.3 | 1.1 | 1.3 | 1.7 | 1.5 | 1.5 | 2.2 | 2.9 | 2.1 | 3.0 |
| Stalling (yes 1/no 0) | 1 | 1 | 0 | 0 | 0 | 0 | 0 | 0 | 1 | 1 | 1 | 1 |

The algorithm was also tested with data, where the measurements were taken from several separate measurement series. There was approximately a month between the measurement series. As can be seen in Table 3 the method works properly even with measurements that have significant difference in time, and hence difference in environmental conditions. Compared with Table 2 the only difference is in the measurement no. 9 where S was just under the limit value. But as mentioned before, the measurement no. 9 is on the border where the fan either stalls or does not stall depending on the operating conditions.

TABLE 3

| | Measurement Number | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Estimated flow rate ($m^3/s$) | 0.9 | 1.4 | 2.0 | 2.5 | 3.0 | 3.6 | 4.1 | 4.5 | 5.5 | 5.5 | 5.5 | 5.5 |

TABLE 3-continued

| | Measurement Number | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| On the stall region (yes 1/no 0) | 1 | 1 | 0 | 0 | 0 | 0 | 0 | 0 | 1 | 1 | 1 | 1 |
| S | 5.8 | 2.5 | 1.7 | 1.1 | 1.4 | 1.2 | 1.7 | 1.5 | 1.9 | 2.3 | 2.6 | 2.9 |
| Stalling (yes 1/no 0) | 1 | 1 | 0 | 0 | 0 | 0 | 0 | 0 | 0 | 1 | 1 | 1 |

It should be noted, that the above calculations and the method can be carried out directly in a frequency converter which provides the rotational speed and torque estimates. Frequency converters contain a vast amount of calculation capacity and memory that can be read and written. If the method is carried out in a frequency converter, it can output indication of stall to the process control system of the plant. It is also possible to carry out the operations of the method in another entity than in the frequency converter. In this case the frequency converter provides estimates of the rotational speed and torque to the other entity, which may be a process computer, for example.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method of determining stall of a fan, when the fan is controlled with a frequency converter having means for providing a rotational speed estimate of the fan and torque estimate of the fan and when characteristic curves of the fan are known and stored in memory of the frequency converter, the method comprising:

in a processor of the frequency converter:

estimating rotational speed (n) of the fan;

estimating torque (T) of the fan;

transferring the characteristic curves given at a first rotational speed of the fan to the estimated rotational speed (n) of the fan using affinity equations;

determining a stall region of the fan from the characteristic curves;

determining an operating point of the fan from the estimated rotational speed (n) and the estimated torque (T) using the characteristic curves;

calculating RMS values of the low frequency components of the torque and rotational speed estimates ($T_{RMS}$, $n_{RMS}$);

combining the calculated RMS values of the low frequency components of the torque and rotational speed estimates ($T_{RMS}$, $n_{RMS}$) for obtaining a low frequency parameter (S) by:

dividing the RMS values by corresponding reference values for obtaining dimensionless values; and calculating the low frequency parameter as a geometric sum of the obtained dimensionless values;

determining an occurrence of stall when the low frequency parameter (S) is above a set limit; and outputting an indication of stall to a process control system to trigger adjustment of the operating point of the fan to a position outside the stall region determined from the characteristic curves of the fan.

2. The method according to claim 1, comprising:

defining two or more rotational speed ranges;

calculating and saving reference values for torque and rotational speed of the fan for each of the rotational speed ranges; and depending on the rotational speed of the fan selecting the reference values from the speed range corresponding to the rotational speed.

3. The method according to claim 1, wherein the calculation of the RMS value of the low frequency components of rotational speed and torque comprises:

estimating rotational speed and torque of the fan for a period of time;

calculating mean value ($\overline{T}$, $\overline{n}$) of the measured data;

calculating unbiased estimate ($T_{unbias}$, $n_{unbias}$) from the measured data by subtracting the mean value of the measured data from the measured data;

filtering the unbiased estimate for obtaining the filtered estimate ($T_{filtered}$, $n_{filtered}$); and calculating RMS values of the low frequency components of rotational speed and torque ($T_{Rms}$, $n_{RMS}$) from the filtered estimate.

4. The method according to claim 1, wherein the low frequency components of torque and rotational speed comprise frequencies in the range of 0 to 2 Hz.

5. The method according to claim 1, wherein the low frequency parameter is compared with a limit value of 2.

6. The method according to claim 1, comprising:

calculating and saving reference values for torque and rotational speed of the fan ($T_{reference}$, $n_{reference}$) from the calculated RMS values of the low frequency components of torque and rotational speed estimates ($T_{RMS}$, $n_{RMS}$) when the operating point of the fan is outside the stall region.

7. The method according to claim 6, comprising:

defining two or more rotational speed ranges;

calculating and saving reference values for torque and rotational speed of the fan for each of the rotational speed ranges; and depending on the rotational speed of the fan selecting the reference values from the speed range corresponding to the rotational speed.

8. The method according to claim 6, wherein the calculation of the RMS value of the low frequency components of rotational speed and torque comprises:

estimating rotational speed and torque of the fan for a period of time;

calculating mean value ($\overline{T}$, $\overline{n}$) of the measured data;

calculating unbiased estimate ($T_{unbias}$, $n_{unbias}$) from the measured data by subtracting the mean value of the measured data from the measured data;

filtering the unbiased estimate for obtaining the filtered estimate ($^{filtered}$, $n_{filtered}$); and calculating RMS values of the low frequency components of rotational speed and torque ($T_{RMS}$, $n_{RMS}$) from the filtered estimate.

9. The method according to claim 6, wherein the low frequency components of torque and rotational speed comprise frequencies in the range of 0 to 2 Hz.

10. The method according to claim 6, wherein the low frequency parameter is compared with a limit value of 2.

11. The method according to claim 6, wherein if the reference values are already saved, then the reference values are calculated as an arithmetic mean of the saved and calculated values, and if the reference values are not saved, then the calculated RMS values are used as reference values.

12. The method according to claim 11, comprising:

defining two or more rotational speed ranges;

calculating and saving reference values for torque and rotational speed of the fan for each of the rotational speed ranges; and depending on the rotational speed of the fan selecting the reference values from the speed range corresponding to the rotational speed.

13. The method according to claim 11, wherein the calculation of the RMS value of the low frequency components of rotational speed and torque comprises:

estimating rotational speed and torque of the fan for a period of time;

calculating mean value ($\overline{T}$, $\overline{n}$) of the measured data;

calculating unbiased estimate ($T_{unbias}$, $n_{unbias}$) from the measured data by subtracting the mean value of the measured data from the measured data;

filtering the unbiased estimate for obtaining the filtered estimate ($T_{filtered}$, $n_{filtered}$); and calculating RMS values of the low frequency components of rotational speed and torque ($T_{RMS}$, $n_{RMS}$) from the filtered estimate.

14. A system of determining stall of a fan, when the fan is controlled with a frequency converter having means for providing a rotational speed estimate of the fan and a torque estimate of the fan and when characteristic curves of the fan are known and stored in memory of the frequency converter, the system comprising:

a processor of the frequency converter configured to:

estimate rotational speed (n) of the fan;

estimate torque (T) of the fan;

transfer the characteristic curves given at a first rotational speed of the fan to the estimated rotational speed (n) of the fan using affinity equations;

determine a stall region of the fan in the characteristic curves;

determine an operation point of the fan from the estimated rotational speed (n) and the estimated torque (T) using the characteristic curves;

calculate RMS values of low frequency components of the torque and rotational speed estimates ($T_{RMS}$, $N_{RMS}$);

combine the calculated RMS values of the low frequency components of the torque and rotational speed estimates ($T_{RMS}$, $n_{RMS}$) to obtain a low frequency parameter (S) by:

dividing the RMS values by corresponding reference values for obtaining dimensionless values; and calculating the low frequency parameter as a geometric sum of the obtained dimensionless values;

determine an occurrence of stall when the low frequency parameter (S)is above a set limit; and output an indication of stall to a process control system to trigger adjustment of the operating point of the fan to a position outside the stall region determined from the characteristic curves of the fan.

* * * * *